US012799762B2

(12) United States Patent
Ernst

(10) Patent No.: US 12,799,762 B2
(45) Date of Patent: Nov. 17, 2026

(54) LAMP POST COLUMN COVER SYSTEM AND METHOD OF COVERING A LAMP POST COLUMN

(71) Applicant: Randy Ernst, Thousand Palms, CA (US)

(72) Inventor: Randy Ernst, Thousand Palms, CA (US)

( * ) Notice: Subject to any disclaimer, the term of this patent is extended or adjusted under 35 U.S.C. 154(b) by 0 days.

(21) Appl. No.: 19/446,673

(22) Filed: Jan. 12, 2026

(65) Prior Publication Data

US 2026/0146465 A1 May 28, 2026

Related U.S. Application Data

(63) Continuation-in-part of application No. 18/787,059, filed on Jul. 29, 2024, now Pat. No. 12,522,998.

(60) Provisional application No. 63/529,497, filed on Jul. 28, 2023.

(51) Int. Cl.
*E04H 12/22* (2006.01)

(52) U.S. Cl.
CPC ..... *E04H 12/2292* (2013.01)

(58) Field of Classification Search
CPC ..... E04H 12/2292; E04H 12/2269; E04H 12/2238; E01F 15/0469; E01F 15/141
See application file for complete search history.

(56) References Cited

U.S. PATENT DOCUMENTS

| | | | | |
|---|---|---|---|---|
| 5,611,173 | A | 3/1997 | Headrick et al. | |
| D531,325 | S * | 10/2006 | Navare | D25/133 |
| 7,455,282 | B2 * | 11/2008 | Platt | E04F 11/1814 256/65.01 |
| 9,404,230 | B2 * | 8/2016 | Habodasz | E01D 19/08 |
| 2003/0000152 | A1 * | 1/2003 | Ryan | E04H 12/2292 267/116 |
| 2007/0116515 | A1 | 5/2007 | Woytowich et al. | |
| 2008/0000192 | A1 * | 1/2008 | McGlinch | E04H 12/2292 52/835 |
| 2012/0212883 | A1 | 8/2012 | Hargreaves et al. | |

* cited by examiner

*Primary Examiner* — Basil S Katcheves
*Assistant Examiner* — Daniel J Kenny
(74) *Attorney, Agent, or Firm* — Invention To Patent Services; Alex Hobson

(57) ABSTRACT

A lamp post column cover is configured for placement around a lamp post to produce a sloped cover extension to prevent trash from being placed on the lamp post column. The lamp post column cover has a post opening around the top of the lamp post column cover and configured around the lamp post a height above the top of the lamp post column. A post opening flange extends vertically around the post opening and is coupled with the cover extension that extends at an extension angle down towards the column flange or base of the lamp post column cover. A plurality of drainage ports are configured along the base of the lamp post column cover and have a drainage port flange extending over the drainage port. The drainage port flange may extend out from the cover extension or from the drainage step of the lamp post column cover.

12 Claims, 14 Drawing Sheets

LAMP POST COLUMN COVER SYSTEM AND METHOD OF COVERING A LAMP POST COLUMN

CROSS REFERENCE TO RELATED APPLICATIONS

This application is a continuation in part of U.S. patent application Ser. No. 18/787,059, filed on Jul. 29, 2024 and currently pending, which claims the benefit of priority to U.S. provisional Ser. No. 63/529,497 , filed on Jul. 28, 2023; the entirety of all prior priority applications are hereby incorporated by reference herein.

BACKGROUND OF THE INVENTION

Field of the Invention

The invention relates to a lamp post column system employing a lamp post column cover assembly that produces a sloped surface extending over the top of the column to the post to prevent placement of items on the lamp post column.

Background

Parking lots, parks, walkways, sidewalks and other public places often have lamp posts that extend up from a lamp post column, such as a cement cylindrical to support the lamp post in position. These lamp post columns are typically much larger in diameter than the lamp post and the top of the column is typically flat; providing a surface for people to place items thereon. In parking lots, people often place trash, such as fast-food cups, food containers, bags and the like on the top of the lamp post column. This attracts birds and other animals which further causes problems as the trash gets spread around the parking lot.

SUMMARY OF THE INVENTION

The invention is directed to an exemplary lamp post column cap system configured for placement around a lamp post to produce a sloped cover extension to prevent trash from being placed on the lamp post column and to divert water from collecting and remaining around the lamp post. The column cap of the lamp post cover assembly forms a post opening configured to extend around the lamp post a height above the top of the lamp post column. A post flange extends to the lamp post and may extend vertically around the post opening. A cover extension extends at an extension angle from the post flange down towards the base flange or base of the column cap. An exemplary lamp post column cap system may also include a column flange component and a column sleeve component. The column sleeve may extend around the lamp post column, and the column flange may extend around the top outer perimeter of the lamp post column and over the column sleeve. The column flange may extend a column flange length. The column cap may have drainage for water to drain out from the interior of the column cap to prevent rusting of the lamp post. The column cap may have column feet that produce a drainage gap. A column cap may have a drainage step that extends down from the cover extension to the base flange. A plurality of drainage ports may be configured along the base of the column cap and have a drainage port flange extending over the drainage port. The drainage port flange may extend out from the cover extension or from the drainage step of the column cap.

The cover extension may extend at an extension angle that is effective to prevent trash and items from being placed therein. The extension angle of the cover extension may extend downward from a horizontal axis an angle large enough to cause items to slide off when placed thereon and may be about 30 degrees or more, about 45 degrees or more, about 55 degrees or more, about 65 degrees or more or even 75 degrees or more. The greater the angle, the greater the height of the column cap.

The outside diameter of the column flange or the base of column cap may be about the same as the diameter of the lamp post column, or about 25 cm or more, about 40 cm or more, about 50 cm or more, about 75 cm or more, about 1 m or more and any range between and including the lengths provided. A cap flange offset distance or a difference in the diameter of the base of the column cap and the diameter of the top of lamp post column may be effectively small to prevent items from being placed on this edge, and may be about 8 cm or less, about 6 cm or less, about 4 cm or less, about 2 cm or less and any range between and including the values provide; smaller is better to prevent even small items from being placed on the top of the lamp post column edge.

A plurality of drainage ports may be configured along the base of the column cap and provide an opening between the column cap and the top of the lamp post column for water and condensation to drain out. The drainage ports may have a drainage port flange, a cover extending over the drainage ports. An exemplary column cap may have two or more, three or more, four or more, six or more or event eight or more drainage ports and the drainage ports may be uniformly arranged about the perimeter of the base. An exemplary column cap is configured with eight drainage ports are arranged uniformly, or at 45 degree offsets from each other, around the perimeter. The drainage step, and drainage port may extend a height from the base of the column cap of about 5 mm or more, about 10 mm or more, about 1 cm or more, about 2 cm or less and any range between and including the height values provided. The width of the drainage port may be about 5 mm or more, about 10 mm or more, about 1 cm or more, about 2 cm or more and any range between and including the width values provided.

The height of an exemplary column cap may be about 10 cm or more, about 12 cm or more, about 16 cm or more, about 20 cm or more, about 25 cm or more and any range between and including the values provided. The height will depend on the extension angle and the base diameter of the column cap.

An exemplary column cap may be made out of a material that is rigid to hold a shape and be durable, but also capable of being deformed about the spit for placement of the column cap around the lamp post and over the lamp post column. A preferred material is plastic, such as polyester, polypropylene, polyethylene and the like. The plastic may include ultraviolet inhibitors to protect the plastic from degradation in the sun. Also, the plastic may include a pigment or color and this color may go along with the color scheme for the parking lot and business of the parking lot, such as red for "Target", as an example. An exemplary column cap, column sleeve and column flange may all be made from a sheet of plastic and the design may enable molding from a single sheet of plastic.

An exemplary column cap may be configured on top of a lamp post column and around a lamp post by producing a split in column cap from the post opening to the outer perimeter in the base of the column cap, such that the split can be opened up starting preferably at the base, or along the outer perimeter and configured around the lamp post. The lamp post may be forced through the split, such as a cut or slit in the column cap from the outer perimeter along the base to the post opening. The column cap may then be forced or slid down along the lamp post, with the lamp post in the post opening, down on top of the top of the lamp post column. The base may rest on the top of the lamp post column. The split may be reduced wherein the lamp post column is resilient and can be stretched or flexed about the split to enable insertion of the lamp post through the split.

An exemplary lamp post column cap is a resilient material that is configured to open up along the split to allow a lamp post to move the lamp post through the split from the outer perimeter along the base to the post opening and then return to an original shape. The split may open in width 500% or more, about 1,000% or more, about 2,000% percent or more. For example, the split may have a width of about 5 mm or less and then expand to accommodate a lamp post that has a diameter of about 100 mm or more, or about 1000% wherein 10 mm would be 100% expansion of the width. Put another way, the width may expand from 10 mm or less, preferably 25 mm or less, to at least 100 mm with the column cap returning to an original shape with the split being enlarged no more than about 50% of an original width, wherein a 25 mm split is no more than 32.5 mm after lamp post insertion.

An exemplary lamp post column cap system includes a column sleeve, a column flange and a column cap. The column sleeve extends around the lamp post column and may have a column sleeve split for configuring, such as by wrapping, the column sleeve around the lamp post column. The sleeve split may extend from a base of the column sleeve to a top of the column sleeve, preferably along a line. Most columns have a circular outer perimeter and the column sleeve may be cylindrical in shape and be a thin sheet of material, such as plastic that can be opened and configured around the lamp post column.

A column flange has a cap flange extension that extends over the top of the lamp post column, under the column cap, and a column flange extension that extends down over the column sleeve. The column flange will direct water flowing off the column cap over the column sleeve. A column flange may also have a cap flange the extends up from the cap flange extension along and inner perimeter of the column flange. A column flange may have a split that separates the column flange for configuring the column flange around and over the top of the lamp post column.

A column cap has a cover extension extending at an extension angle up to the post flange. The post flange extends toward the lamp post. The column cap is configured a cap flange-offset distance from the outside perimeter of the column flange or from the column flange extension. The cap flange-offset distance may be about 5 mm or more, about 10 mm or more, about 15 mm or more, about 25 mm or more, about 30 mm or less, about 25 mm or less, and any range between and including the cap flange-offset distances provided. This cap flange-offset distance may be small to prevent people from placing trash on this horizontal surface. The column cap has a plurality of cap feet that extend down and rest on the cap flange extension of the column flange to produce a drainage gap having a drainage gap height for allowing water to flow out over the cap flange extension of the column flange and over the column sleeve. The drainage gap height may be about 2 mm or more, about 4 mm or more, about 5 mm or more, about 8 mm or even 10 mm or more and any range between and including the drainage gap heights provided. The drainage gap height may be kept small to prevent people from stuffing trash therein. A column cap may have a split extending from an inner perimeter to and outer perimeter, preferably along a line, to enable the column cap to be opened and configured around a lamp post.

A method of installing the lamp post column cap system includes first configuring the column sleeve around the lamp post column. Then the column flange is configured around the top of the lamp post column. The column cap is then configured over the column flange and is secured by fasteners, such as screws into the lamp post column. The column cap may have fastener aperture for receiving the fasteners therethrough. The fasteners will extend through the column cap, and into the column flange. The fasteners may extend into the column and the fasteners may be concrete anchor screws.

A column flange has a cover extension, the portion of the column flange that extends over the top of the lamp post column and post extension that extends along an interior perimeter of the column flange toward or along the lamp post. The column cap extends over the column flange. A fastener may extend through the column cap and into the column flange to secure these two portions of the lamp post column cap assembly together.

A column sleeve of the lamp post column cap system may be cylindrical in shape to extend around the lamp post column. The column sleeve extends a height from a base to a top and has a diameter. The column sleeve has an inside surface configured to extend over the lamp post column and an outside surface configured to be exposed.

An exemplary column flange has a rain flange that extends up from the cap flange extension and a column flange that extends down from the cap flange extension. The rain flange extends up a rain flange height to prevent precipitation from flowing in over the top of the lamp post column, and the cap flange extension extends a cap flange extension length between the rain flange and the column flange extension. The column flange has an inside diameter and an outside diameter. The column flange forms an aperture and may have a column flange split to enable the column flange to be configured over a lamp post column and around the lamp post.

An exemplary column cap of the lamp post column cap system may be configured as two column cap components. The two column cap components may be the same design, having the same shape and features. Each of the column cap components have a coupling flange configured to extend under opposing column cap component to couple together the two column cap components. Each of the two column cap components extend half a circle or 180 degrees along a radius, or between about 170 degrees and 190 degrees. Each column cap component has cap feet that extend down to form the drainage gap. A cap foot may include a fastener aperture for receiving a fastener, such as a screw, therethrough. Also, each cap foot may be formed by a foot recess from the cover extension, which enables the column cap component to be molded from a single sheet of material, wherein the column cap component is a contiguous planar sheet of material, such as a plastic sheet. The cover extension extends along an extension angle from a horizontal axis. A post flange extends along a concave post extension that extends along a radius of curvature that is configured to conform to the diameter of the post. The foot extension extends a drainage gap height.

A lamp post column cap assembly may include a column cap configured over the column flange portion of a column sleeve-flange that includes a column sleeve portion configured to extend down along the lamp post column and said column flange portion, that extends over the top of the lamp post column. The lamp post column cover system may include four components, two column cap portions and two column sleeve-flanges, wherein the column sleeve or column sleeve portion extends from the column flange extension. The two column sleeve-flanges may be coupled together around the lamp post column and then the two column cap portions may be coupled together and then secured over the column flange portion of the column sleeve-flanges. The column flange extension and column sleeve may be a single piece of material that extends continuously down along the side of the lamp post column from the top of the column sleeve to the base of the column sleeve. Put another way, the column flange extension forms the column sleeve and extends down to the base of the column sleeve.

The two column sleeve-flanges may be secured together around the lamp post column by column-sleeve fasteners that may extend from a first column sleeve-flange portion to a second column sleeve-flange portion to form a column sleeve attachment. The column-sleeve fasteners may extend into a column sleeve-flange attachment recess to prevent tampering with the fasteners and to produce a smooth outer profile of the column sleeve portion that may prevent snags on a person's clothing as they walk by the lamp post column cap assembly. Each column sleeve-flange may include a plurality of column sleeve-flange edge protrusions and corresponding column sleeve-flange edge recess to receive the column sleeve-flange edge protrusion. The two column sleeve-flange portions may be coupled together via insertion of the column sleeve-flange edge protrusions into the column sleeve-flange edge recess and subsequently, fastening the two portions together via the column sleeve fasteners.

The column cap may include a split or cap coupling edge to enable the column cap to be configured around a lamp post. The column cap may include two column cap components and two splits or cap coupling edges that are coupled together.

The column sleeve flange portion of the column sleeve-flange has a cap flange extension that extends from the rain flange over the top of the lamp post column, when in use, and may extend horizontally with respect to a vertical axis. The column sleeve flange portion may also have a cap flange drainage extension extending at an extension angle from horizontal, which may be about 25 degrees or more, about 30 degrees or more, about 45 degrees or more and any range between and including the angles provided. This sloped cap flange drainage extension may promote drainage of water from the cap flange extension as well as from the cover extension of the column cap. The rain flange extends vertically up to stop water or rain from passing thereover and onto the lamp post or lamp post column.

The column sleeve portion or column sleeve may include column sleeve recessed areas, such as rectangular recesses areas. These recessed areas may improve the stiffness and rigidity of the column sleeve and may extend a substantial portion of the length or height of the column sleeve from the base to the top 68 and may have a length of about 50 mm or more, about 75 mm or more, about 100 mm or more, about 150 mm or more, about 200 mm or more and any range between and including the length values provided. The width of the column sleeve recessed areas 672 may be about 25 mm or more, about 50 mm or more, about 75 mm or more, about 100 mm or more and any range between and including the values provided. The area of the recessed areas may me a substantial portion of the area of the column sleeve, such as about 25% or more, about 50% or more, or even about 70% or more and any percentage between and including the values provided.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
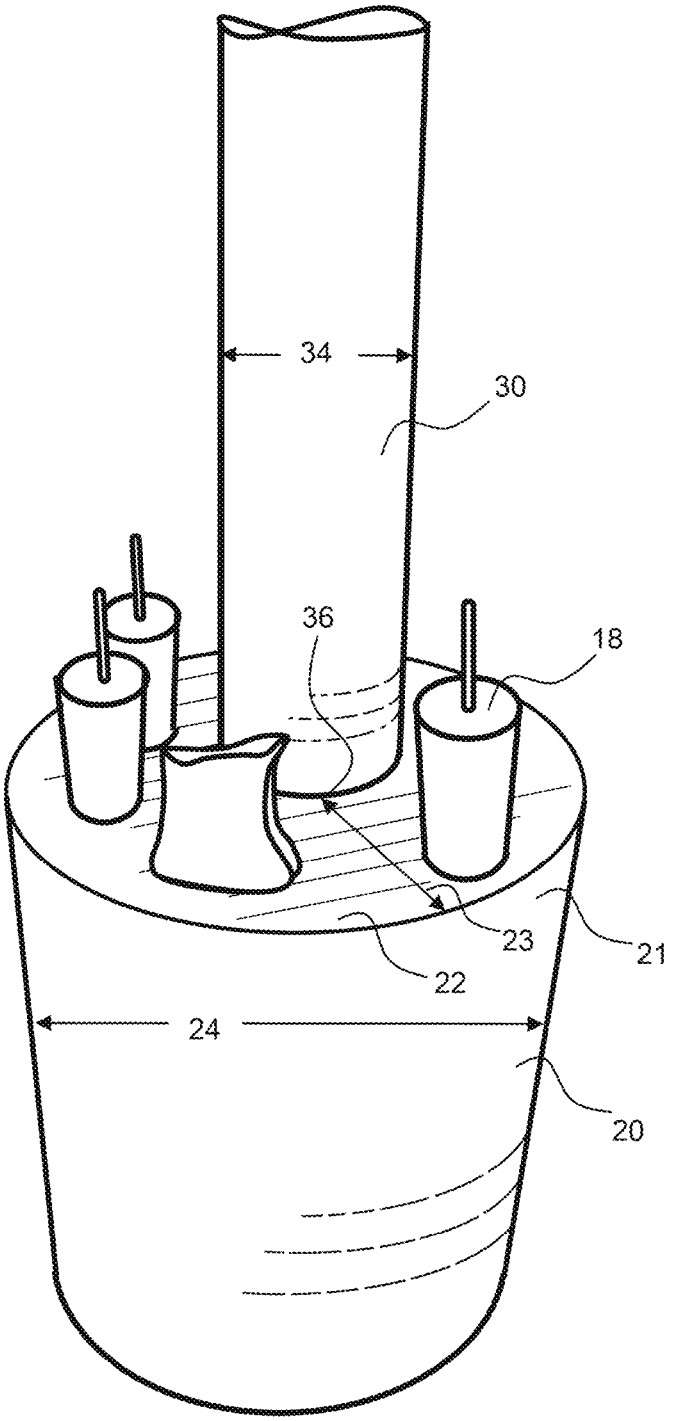
FIG. 1 shows a perspective view of a lamp post column and lamp post extending therefrom with trash resting on the top of the lamp post column.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including,"

"has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a lamp post column 20 supports a lamp post 30 that extends up from the top 22 of the lamp post column. The top of the lamp post column is flat and extends horizontally providing a location for people to place trash 18, such as fast-food beverage containers, food packaging and bags. As detailed herein, the trash attracts birds and animals that results in the trash being spread around the area. This is unattractive and cost money in employee time for cleanup.

The lamp post 30 has a lamp post diameter 34 that is much smaller than the lamp post column diameter 24. As described herein, the top 22 of the lamp post column produces a horizontal surface having a length 23 from the lamp post 30, or lamp post column intersection 36, to the outside perimeter 21 of the top of the lamp post column 20, which may be about 10 cm or more, about 12 cm or more, about 15 cm or more, about 20 cm or more, about 25 cm or more, about 30 cm or more and any range between and including the lengths provided. The lamp post 30 intersects with the lamp post column 20 at a lamp post column intersection 36. The lamp post column 20 has a height 27 from the ground surface 25 to the top 22 of the lamp post column and this height may be about 0.5 m or more, about 0.7 m or more, about 1 m or more, about 1.25 m or more, about 1.5 m or less and any range between and including the height values provided.

Figure 2:
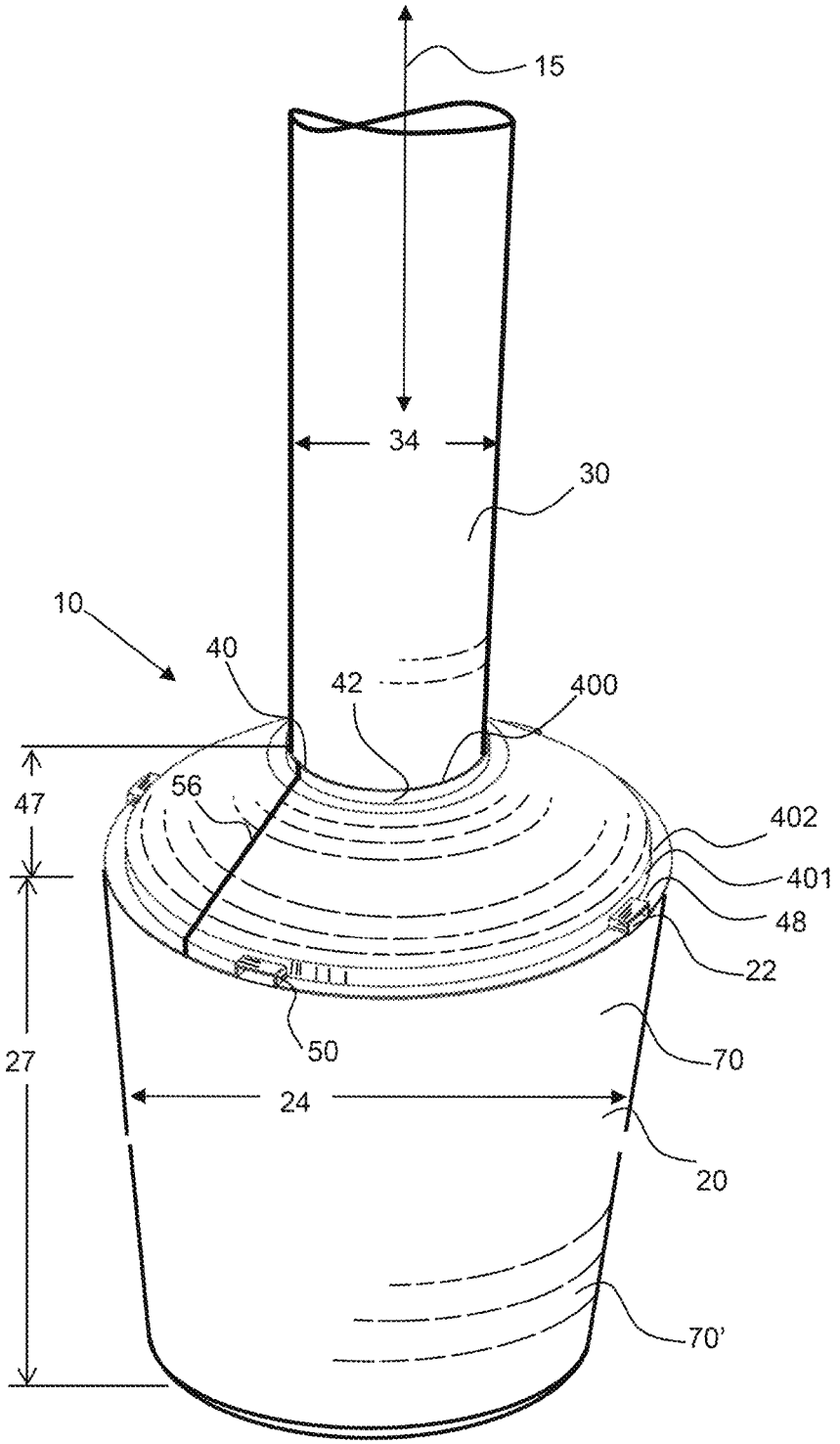
FIG. 2 shows a perspective view of a lamp post column with an exemplary column cap configured around the lamp post to produce a sloped cover extension to prevent trash from being placed on the lamp post column.

As shown in FIG. 2, the lamp post column 20 is configured with an exemplary column cap 10 configured around the lamp post 30 to produce a sloped cover extension 44 to prevent trash from being placed on the lamp post column. The column cap has a post opening 40 around the top 400 of the column cap 10 and configured around the lamp post 30 a height 47 above the top 22 of the lamp post column 20. A post opening flange 42 extends vertically around the post opening and is coupled with the cover extension 44 that extends at an extension angle down towards the base flange 48 or base 402 of the column cap 10. The base 402 is configured to rest on the top 22 of the lamp post column 20. A drainage step 45 extends down from the cover extension 44 to the base flange 48. A plurality of drainage ports 50 are configured along the base 402 of the column cap 10 and have a drainage port flange 52 extending over the drainage port 50. The drainage port flange may extend out from the cover extension or from the drainage step 45 of the column cap 10.

The column cap 10 has a split 56 that extends from the top 400 to the base 402 that enables the column cap to be configured around the lamp post 30 and over the lamp post column 20 by prying open the column cap and placement of the lamp post 30 through the opened split 56. The lamp post may be first inserted along the split at the base 402 and then forced up along the split to the post opening 40 in the top 400 of the column cap 10.

Figure 3:
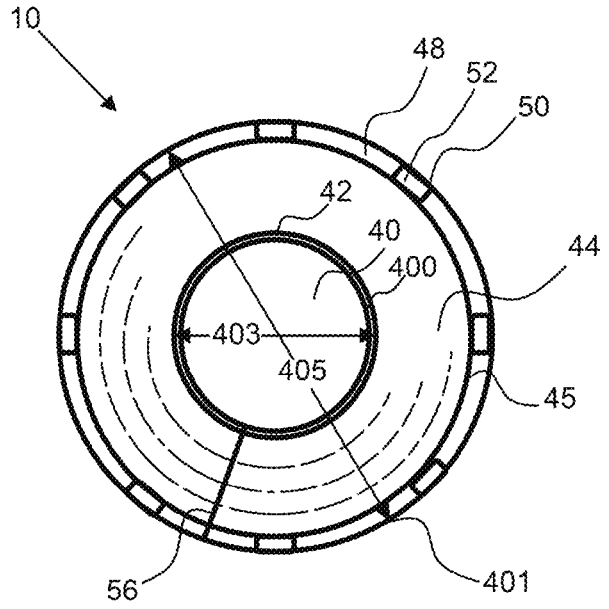
FIG. 3 shows a top view of an exemplary column cap having a post opening to extend around the lamp post and a cover extension extending at a cover extension angle down towards the base of the column cap.
Figure 4:
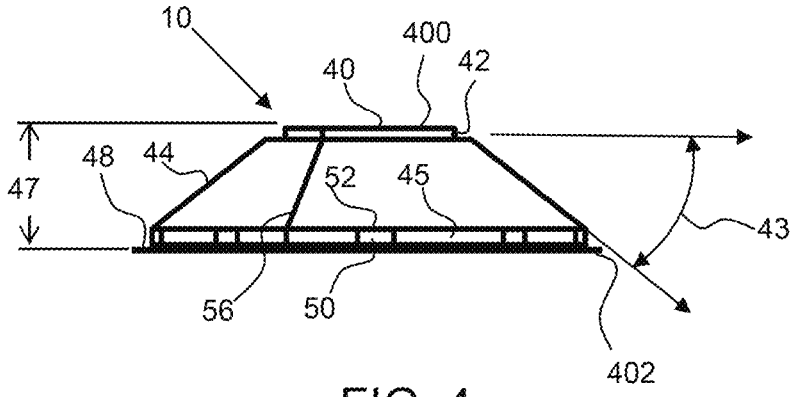
FIG. 4 shows a side view of exemplary column cap having a post opening to extend around the lamp post and a cover extension extending at a cover extension down to the base flange.

Referring now to FIGS. 3 and 4, an exemplary column cap 10 has a post opening 40 configured to extend around the lamp post and a cover extension 44 extending at an extension angle 43 down toward the base 402 of the column cap 10. The extension angle as shown is about 45 degrees. The post opening flange 42 extends vertically up from the cover extension 44 to the top 400 of the column cap 10. The column cap 10 has a height from the base 402 to the top 400 and a diameter 405 across the base and diameter 403 across the post opening 40.

The cover extension 44 extends down to the drainage step 45, a vertical extension from the cover extension down to the base 402 or bottom of the column cap 10. A plurality of drainage ports 50 are configured along the base of the column cap 10 and provide an opening between the column cap and the top 22 of the lamp post column 20 for water and condensation to drain out. The drainage ports may have a drainage port flange 52, a cover extending over the drainage ports 50. An exemplary column cap 10 may have two or more, three or more, four or more, six or more or even eight or more drainage ports and the drainage ports may be uniformly arranged about the perimeter 401 of the base. As shown, eight drainage ports 50 are arranged uniformly, or at 45 degree offsets from each other, around the perimeter 401.

Figure 5:
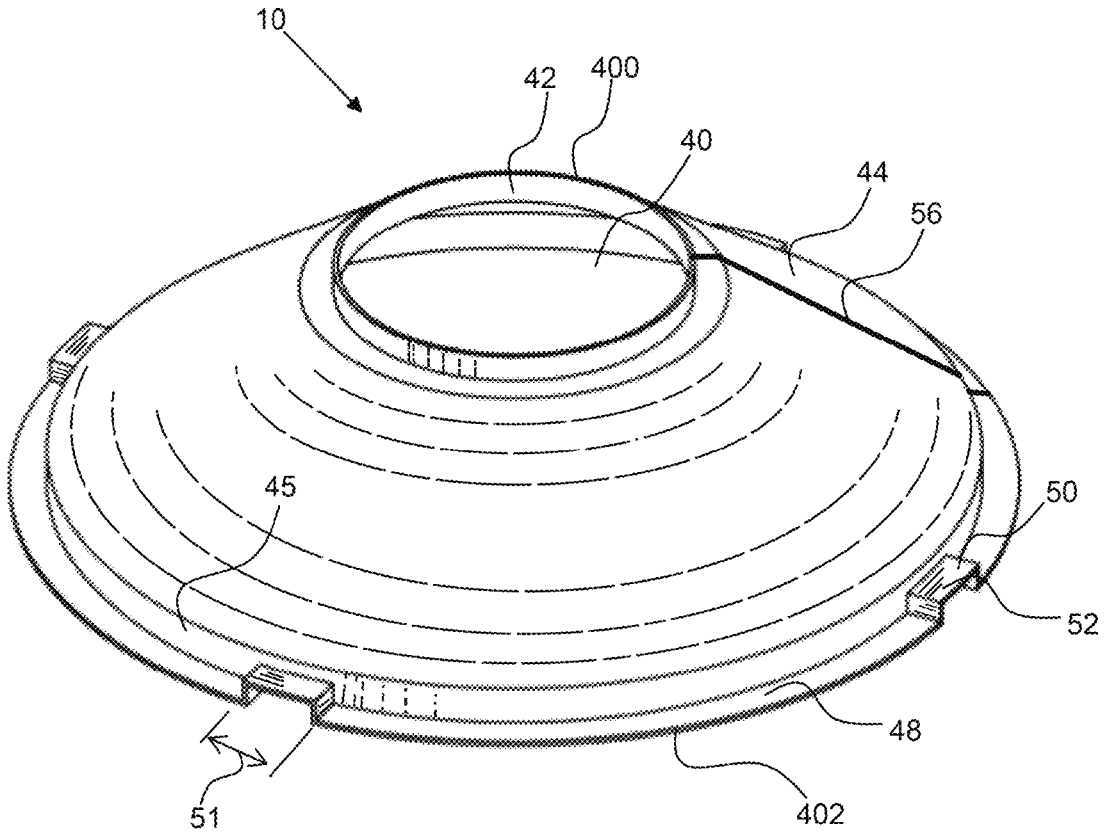
FIG. 5 shows a perspective view of an exemplary column cap having four drainage ports configured uniformly around the outer perimeter at 90 degree offset angles from each other.
Figure 6:
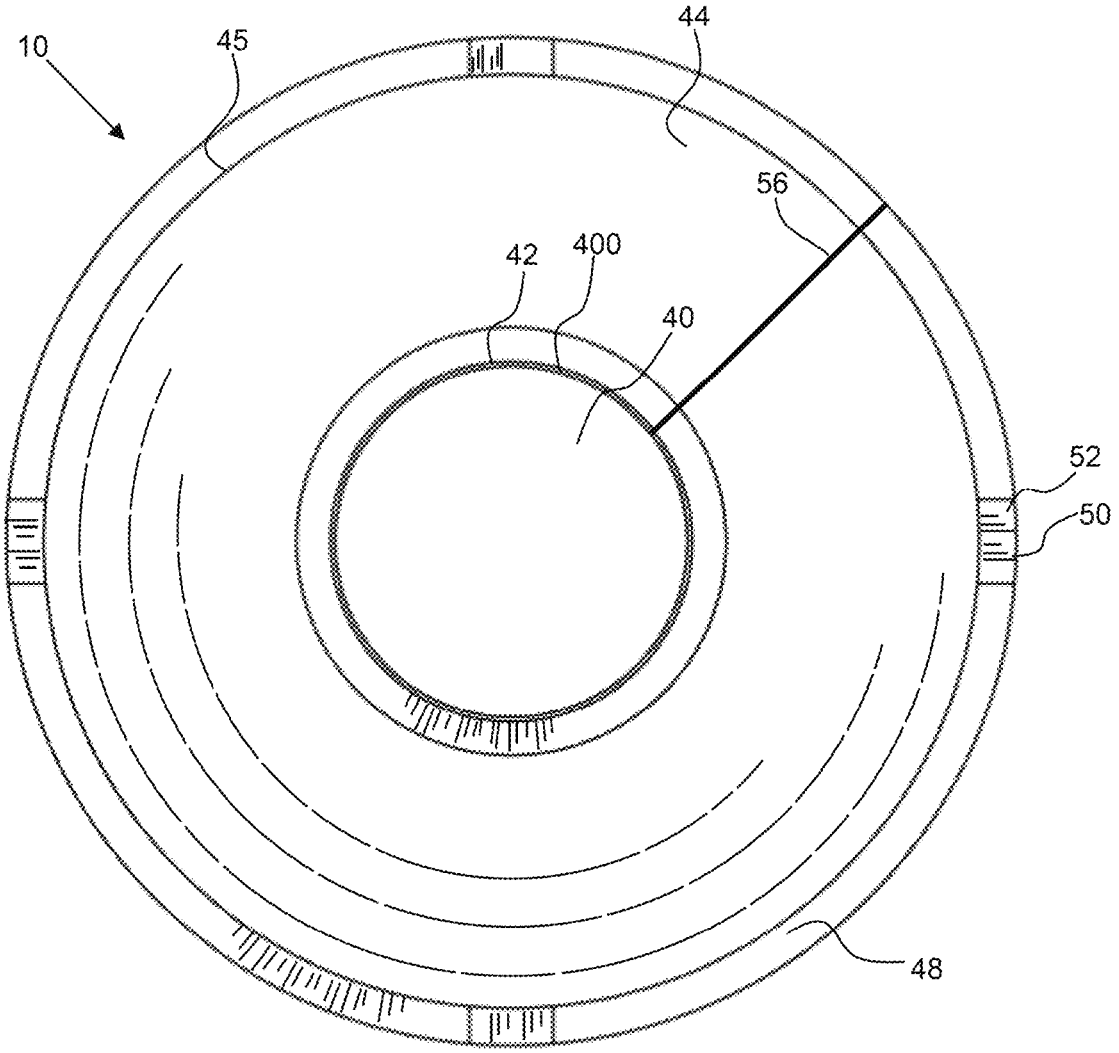
FIG. 6 shows a top view of the exemplary column cap shown in FIG. 5.
Figure 7:
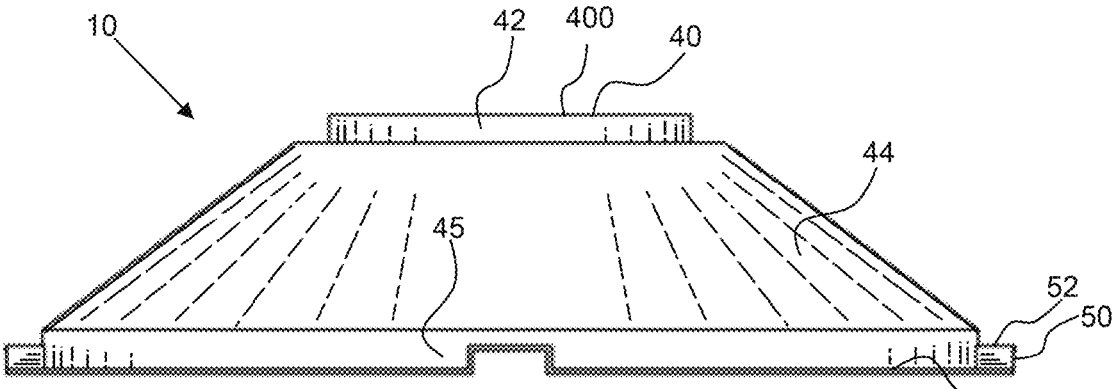
FIG. 7 shows a front view of the exemplary column cap shown in FIG. 5.
Figure 8:
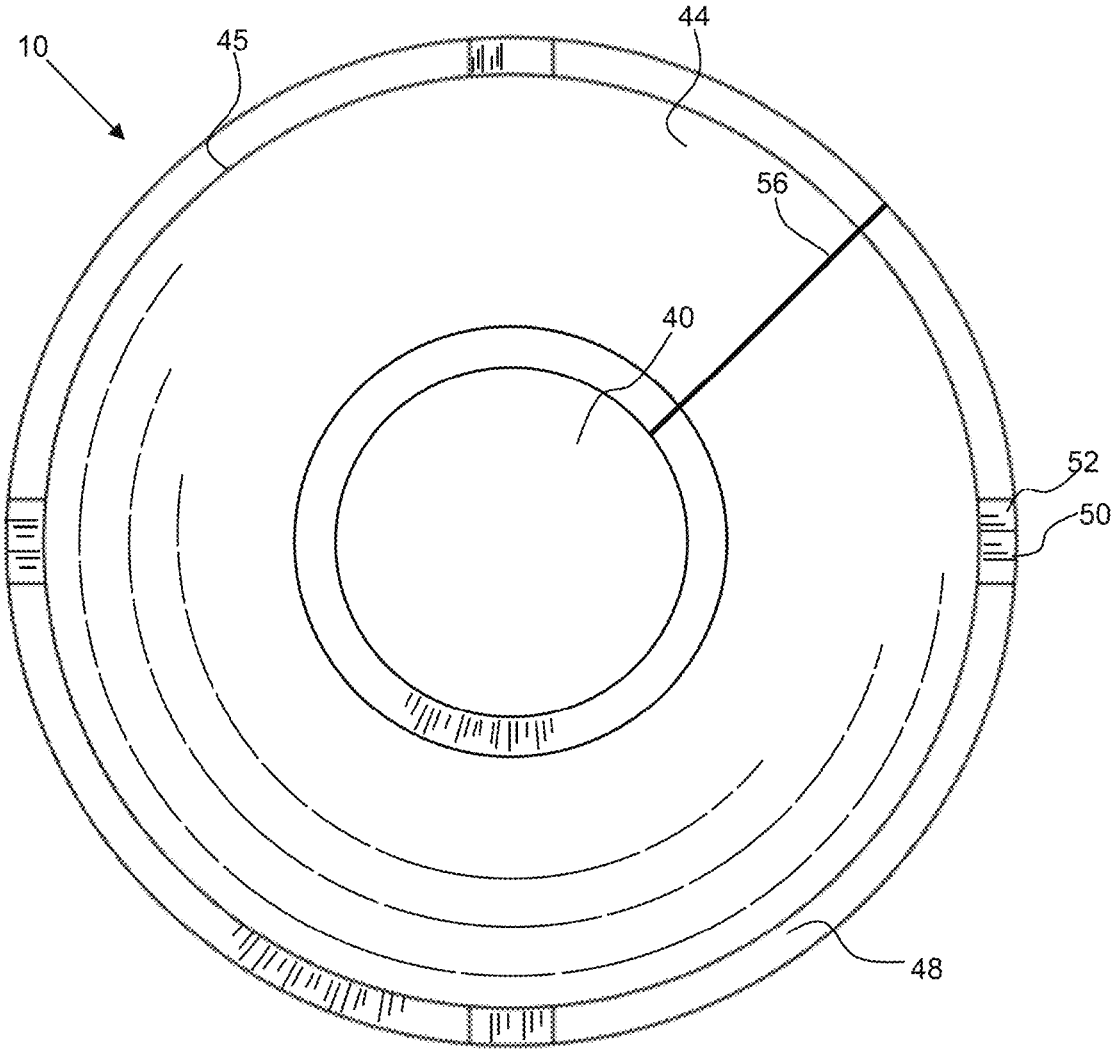
FIG. 8 shows a bottom view of the exemplary column cap shown in FIG. 5.
Figure 9:
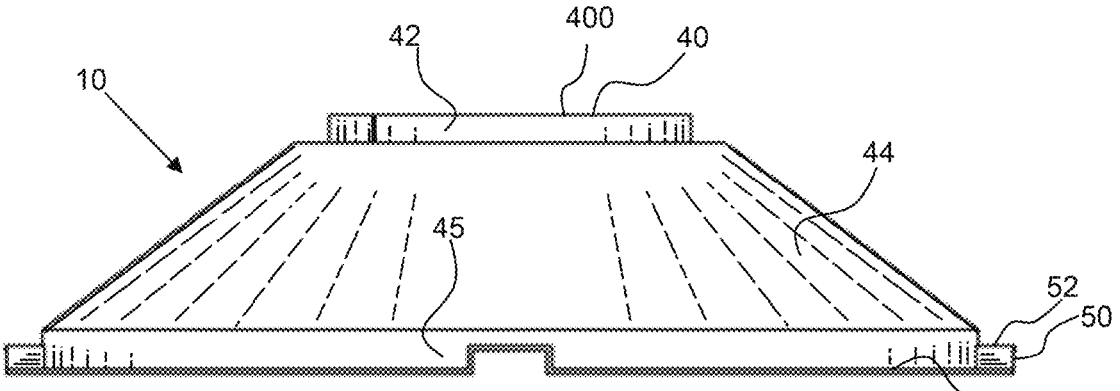
FIG. 9 shows a back view of the exemplary column cap shown in FIG. 5.

Referring now to FIGS. 5 to 9, an exemplary column cap 10 has four drainage ports 50 shown in FIG. 5. Each drainage port 50 has a drainage port flange 52. There are four drainage ports 50 in this embodiment, and they are uniformly configured around the perimeter of the column cap, or at 90 degree offsets from each other. A post opening 40 is configured in the top 400 of the lamp post column 10 and a post opening flange 42 extends vertically up along the post opening. The drainage port has a drainage port length 51 as shown in FIG. 5, and a height up from the base 402 to the drainage port flange 52.

Figure 10:
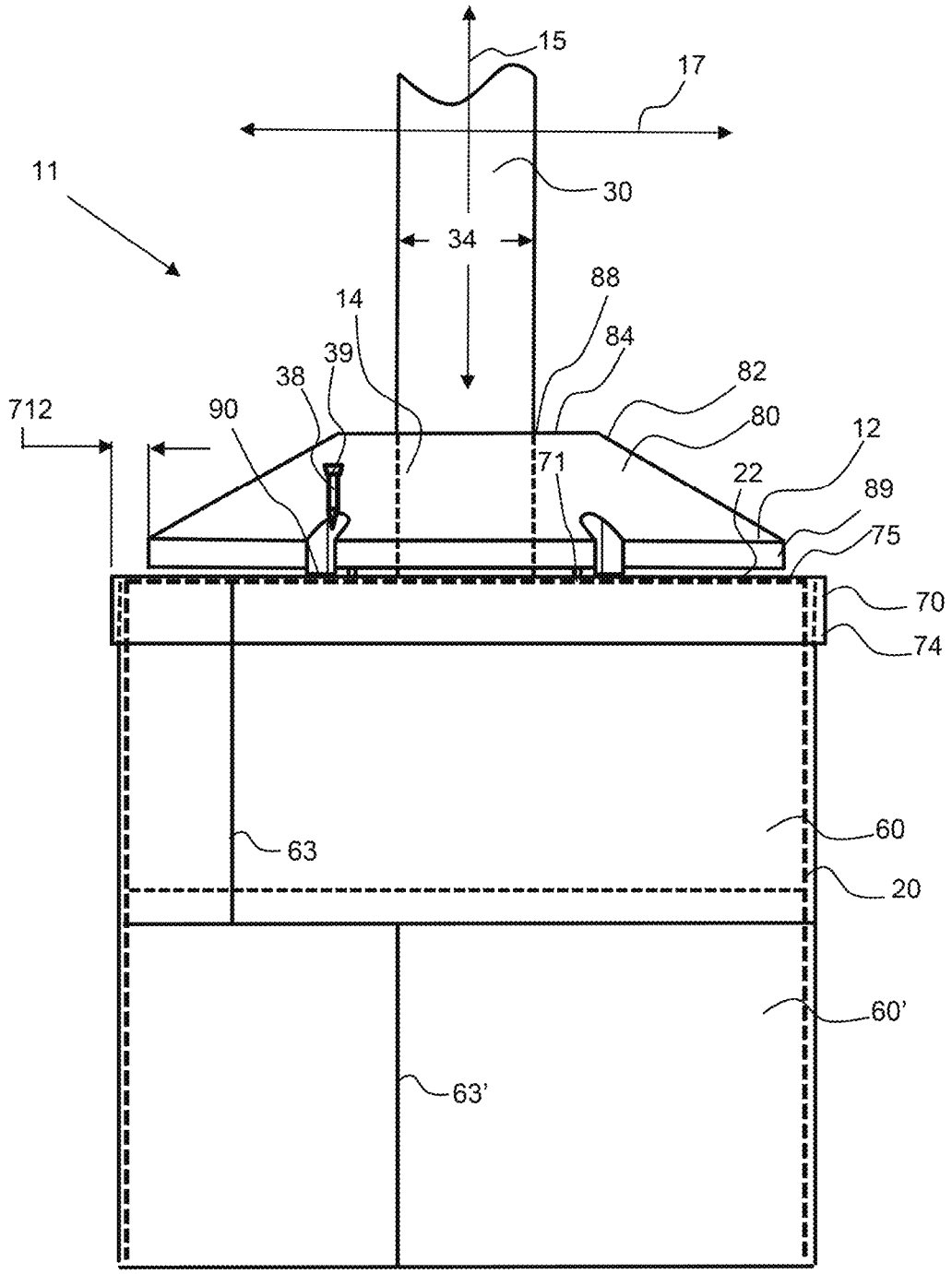
FIG. 10 shows a side view of a lamp post column cap system including a column sleeve, a column flange and a column cap.
Figure 11:
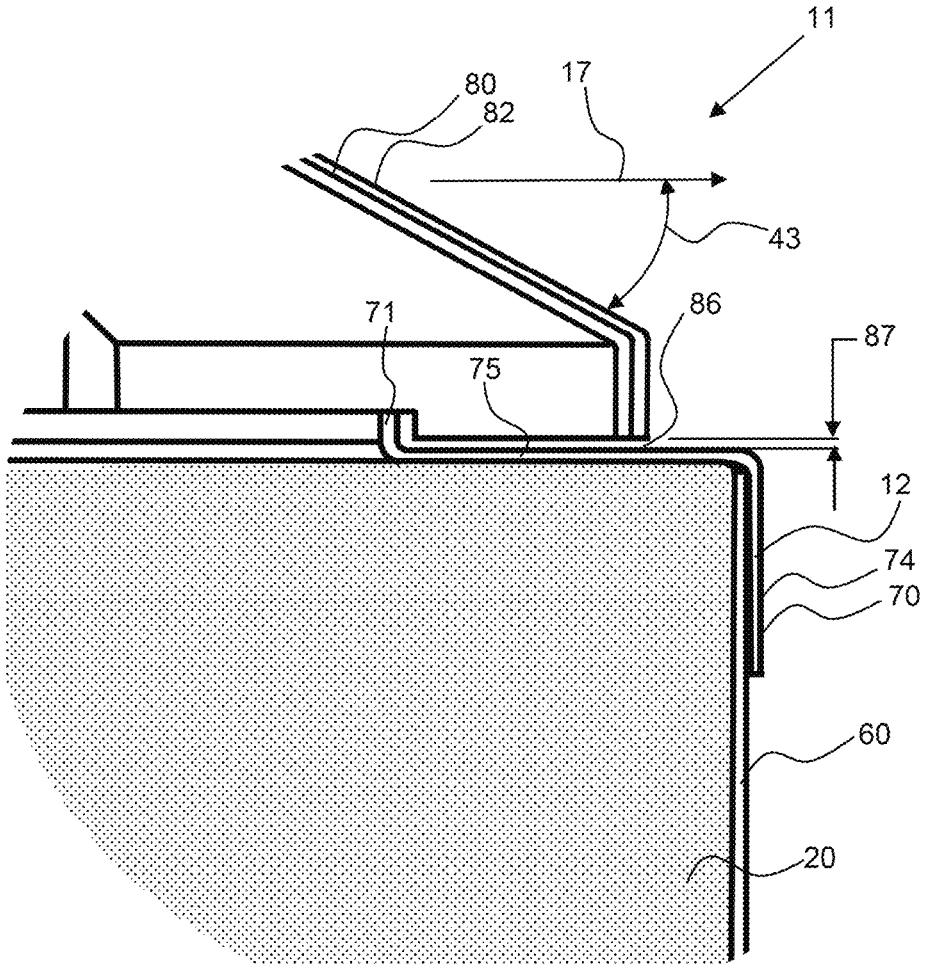
FIG. 11 shows a cross sectional view of a top corner of a lamp post column with the lamp post column cap system configured thereon.

The column cap 10 shown in FIG. 2 to 9 maybe used in a lamp post column cap assembly 12, as shown in FIGS. 10 and 11 and extend over a column flange 70 and include a column sleeve 60 configured around the lamp post column 20.

Referring now to FIGS. 10 to 19, an exemplary lamp post column cap system 11 includes a column sleeve 60, a column flange 70 and a column cap 80 forming a lamp post column cap assembly 12. The lamp post column cap assembly 12 covers the column top and a portion of the lamp post 30 to prevent precipitation from collecting in and around the lamp post, lamp post column 20 intersection. The post flange 84 of the column cap 80 may extend around the lamp post and have a small gap, or post opening space between the post flange and the outer perimeter of the lamp post 30 such as no more than about 30 mm, about 25 mm or less, about 20 mm or less, and preferably about 15 mm or less, 10 mm or less, or even 5 mm or 3 mm or less and any range between and including the values provided. A rain flange 71 extends up along the inside perimeter of the column flange and prevents blowing rain and precipitation from flowing in and collecting along the base of the lamp post. Also, a drainage gap 86 shown in FIG. 11 enables any moisture on the column flange 70 to dry out and/or flow off of the column flange and down over the column sleeve 60.

Figure 19:
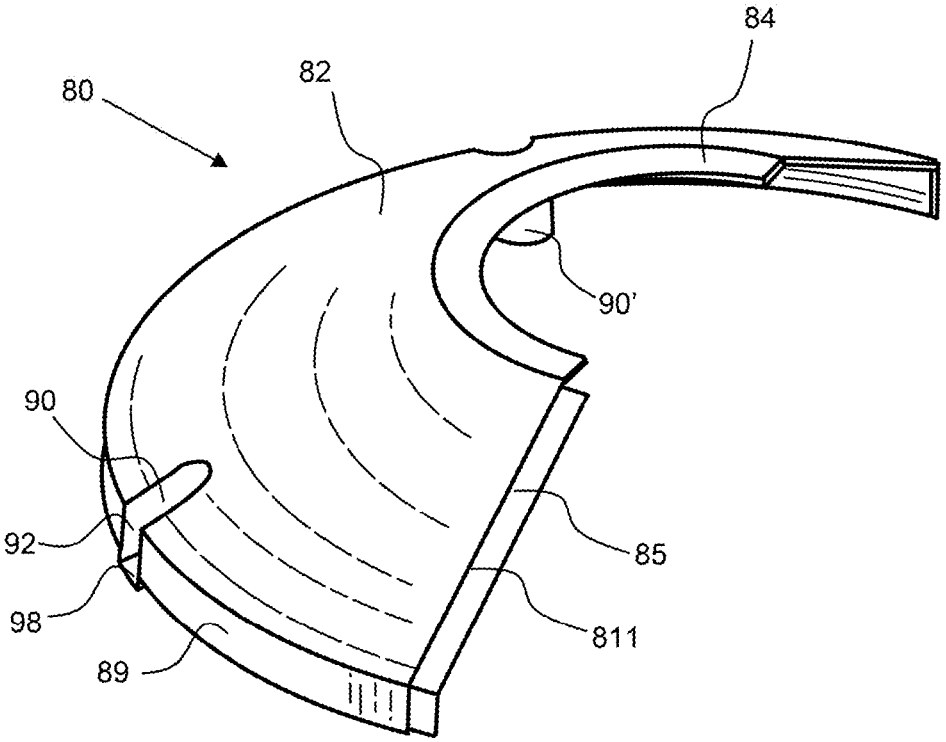
FIG. 19 shows a top perspective view of the column cap of the lamp post column cap system.

As shown in FIG. 10 a pair of column sleeves 60, 60' extend around the lamp post column 20 to cover the lamp post column 20 with a first column sleeve 60 extending over the second column sleeve 60' column sleeve. There may be an overlap of the first column sleeve over the second column sleeve to ensure water flows down over the first and second column sleeves and away from the lamp post column. Each column sleeve 60 may have a respective column sleeve split 63, 63' for configuring, such as by wrapping, the column sleeve around the lamp post column. Most columns have a circular outer perimeter and the column sleeve may be cylindrical in shape. A column flange 70 has a cap flange extension 75 that extends over the top 22 of the lamp post column and a column flange extension 74 that extends down a column flange length 745 over the column sleeve 60. The column flange will direct water flowing off the column cap 80 over the column sleeve 60. A column cap 80 has a post opening 88 for the lamp post 30 to extend therethrough. A post opening is formed by the inner perimeter of the two column cap components 81, shown in FIG. 17. A column cap 80 has a cover extension 82 extending at an extension angle 43 up to the post flange 84, as best shown in FIG. 19. The post flange extends toward the lamp post. The column cap 80 is configured a cap flange-offset distance 712 from the outer perimeter of the column flange or from the column flange extension of the column flange 70, as shown in FIG. 10. The column cap 80 has a plurality of cap feet 90 that extend down and rest on the cap flange extension 75 of the column flange 70 to produce a drainage gap 86 having a drainage gap height 87 for allowing water to flow out over the column flange 70 and over the column sleeve 60, as shown in FIG. 11.

As shown in FIG. 10, the lamp post column 20 is covered by the lamp post column cap system 11. A method of installing the lamp post column cap system includes first configuring the column sleeve 60 around the lamp post column 20 by opening the column sleeve about the column sleeve split 63. Then the column flange is configured around the top 22 of the lamp post column again, by opening the column flange about the column flange split or edge. Then the column cap 80 is configured over the column flange by inserting each of the coupling flanges of the two column caps under the opposing column cap component. The column cap components may then be secured by fasteners 38, such as screws 39 into the lamp post column 20. The column cap may have fastener aperture 94 for receiving the fasteners therethrough. The fasteners will extend through the column cap 80, and into the column flange 70. The fasteners may extend into the column and the fasteners may be concrete anchor screws.

As shown in FIG. 11, the column flange 70 has a cap flange extension 75, the portion of the column flange that extends over the top 22 of the lamp post column 20 and rain flange 71 that extends up along an interior perimeter of the column flange. The column flange also has a column flange extension 74 that bends down over the column and over and around the column sleeve 60. As described herein, a fastener may extend through the column cap and into the column flange to secure these two portions of the lamp post column cap assembly 12 together.

Figure 12:
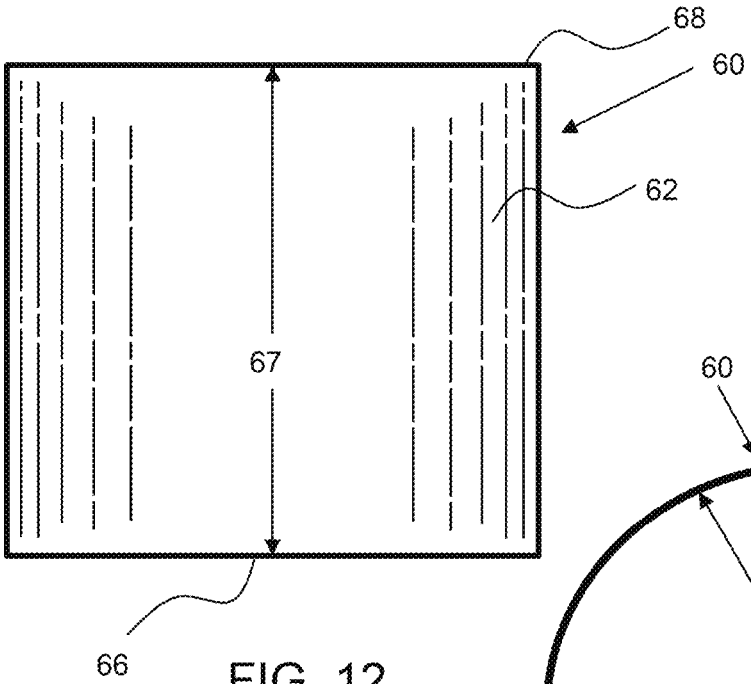
FIG. 12 shows a side view of the column sleeve of the lamp post column cap system.
Figure 13:
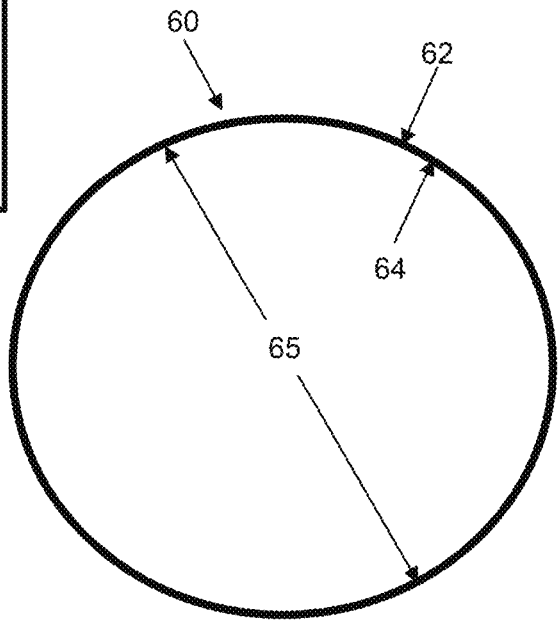
FIG. 13 shows a top view of the column sleeve of the lamp post column cap system.
Figure 14:
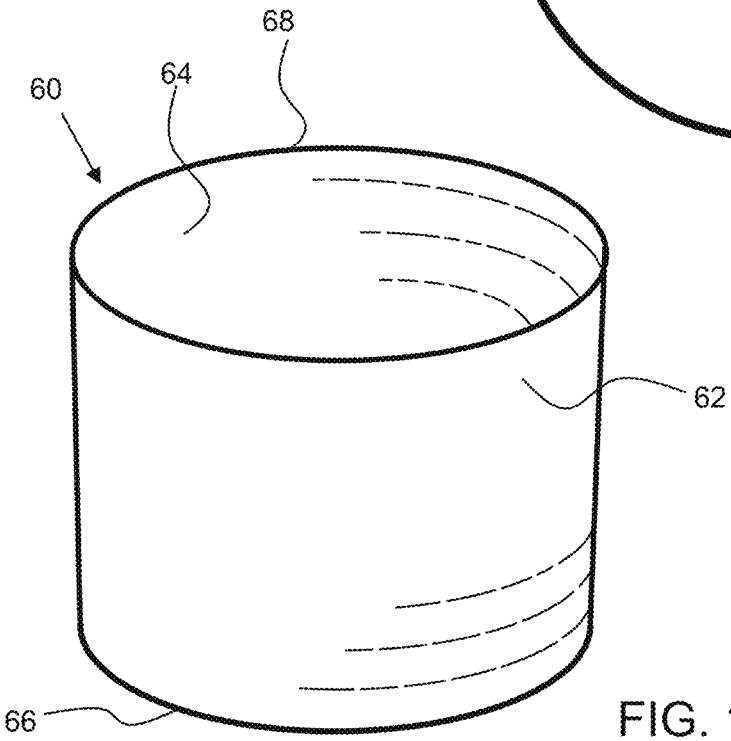
FIG. 14 shows a perspective top view of the column sleeve of the lamp post column cap system.

Referring now to FIGS. 12 to 14, a column sleeve 60 of the lamp post column cap system 11 may be cylindrical in shape to extend around the lamp post column. The column sleeve extends a height 67 from a base 66 to a top 68 and has a diameter 65. The column sleeve 60 has an inside surface 64 configured to extend over the lamp post column and an outside surface 62 configured to be exposed. As described herein a lamp post column may be covered by one, or two or more column sleeves. The column sleeve may have a height that is conducive for shipment and may be on the order of about 30 cm or more, about 35 cm or more, about 40 cm or more, about 50 cm of less and any range between and including the values provided.

Figure 15:
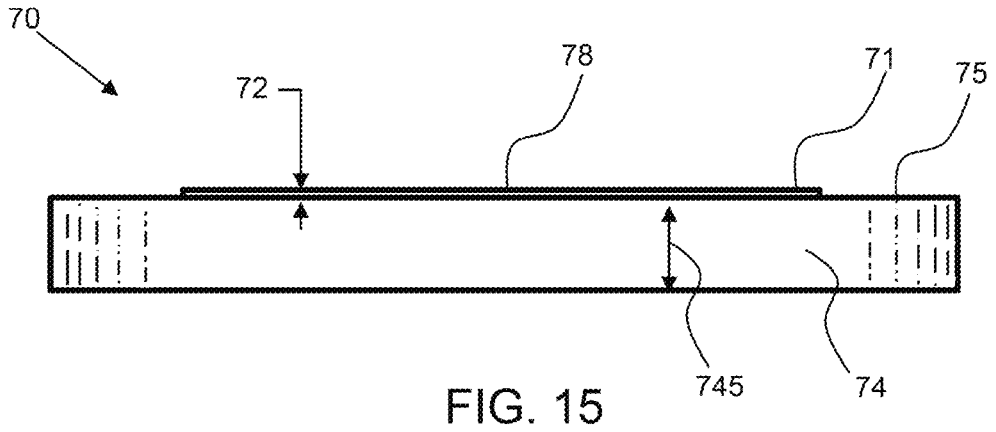
FIG. 15 shows a side view of the column flange of the lamp post column cap system.
Figure 16:
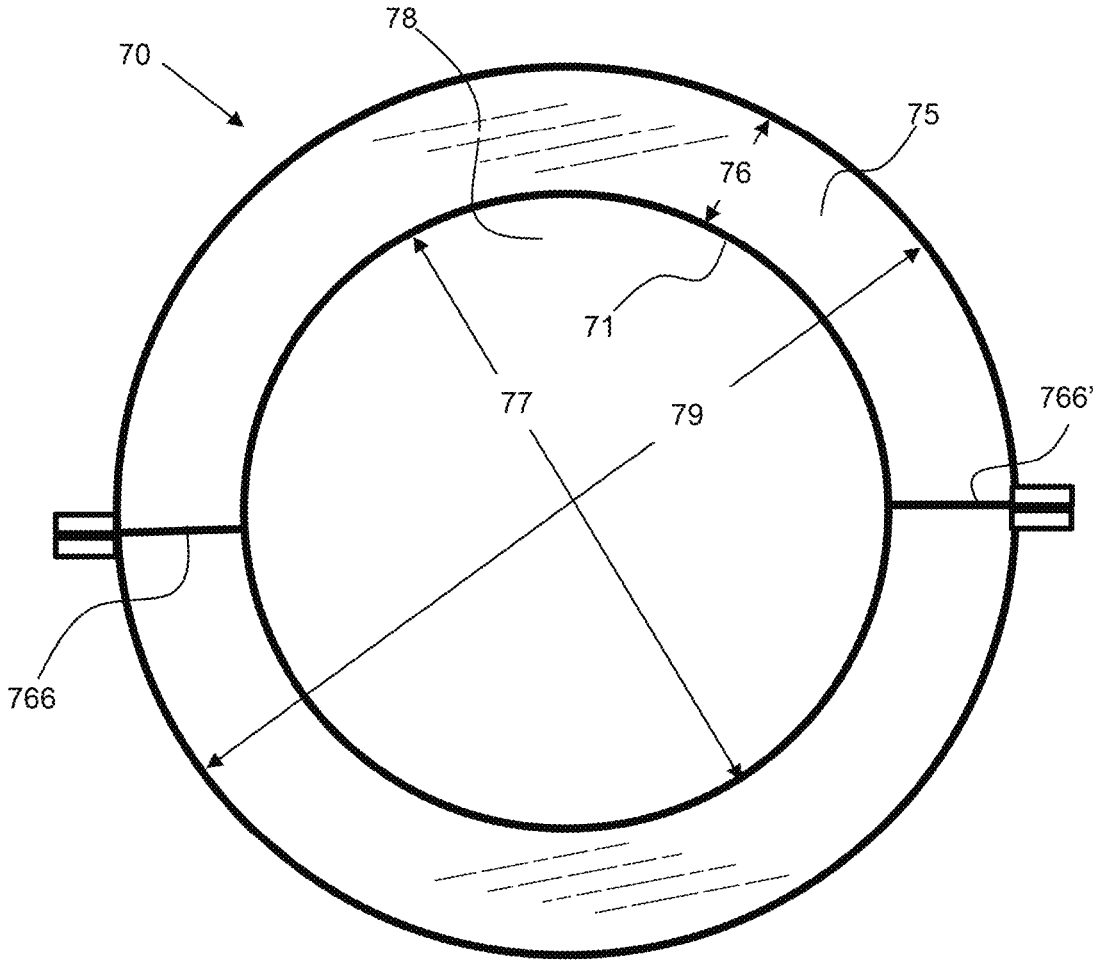
FIG. 16 shows a top view of the column flange of the lamp post column cap system.

Referring now to FIGS. 15 and 16, a column flange 70 has a rain flange 71 that extends up from the cap flange extension 75 and a column flange extension 74 that extends down from the cap flange extension. The rain flange extends up vertically a rain flange height 72 from the cap flange extension, and the cap flange extension extends a cap flange extension length 76 between the rain flange 71 and the column flange extension 74. The column flange has an inside diameter 77 and an outside diameter 79. The column flange forms an aperture 78 and may have a column flange split 766 or column flange splits 766, 766' to enable the column flange to be configured over a lamp post column and around the lamp post.

Figure 17:
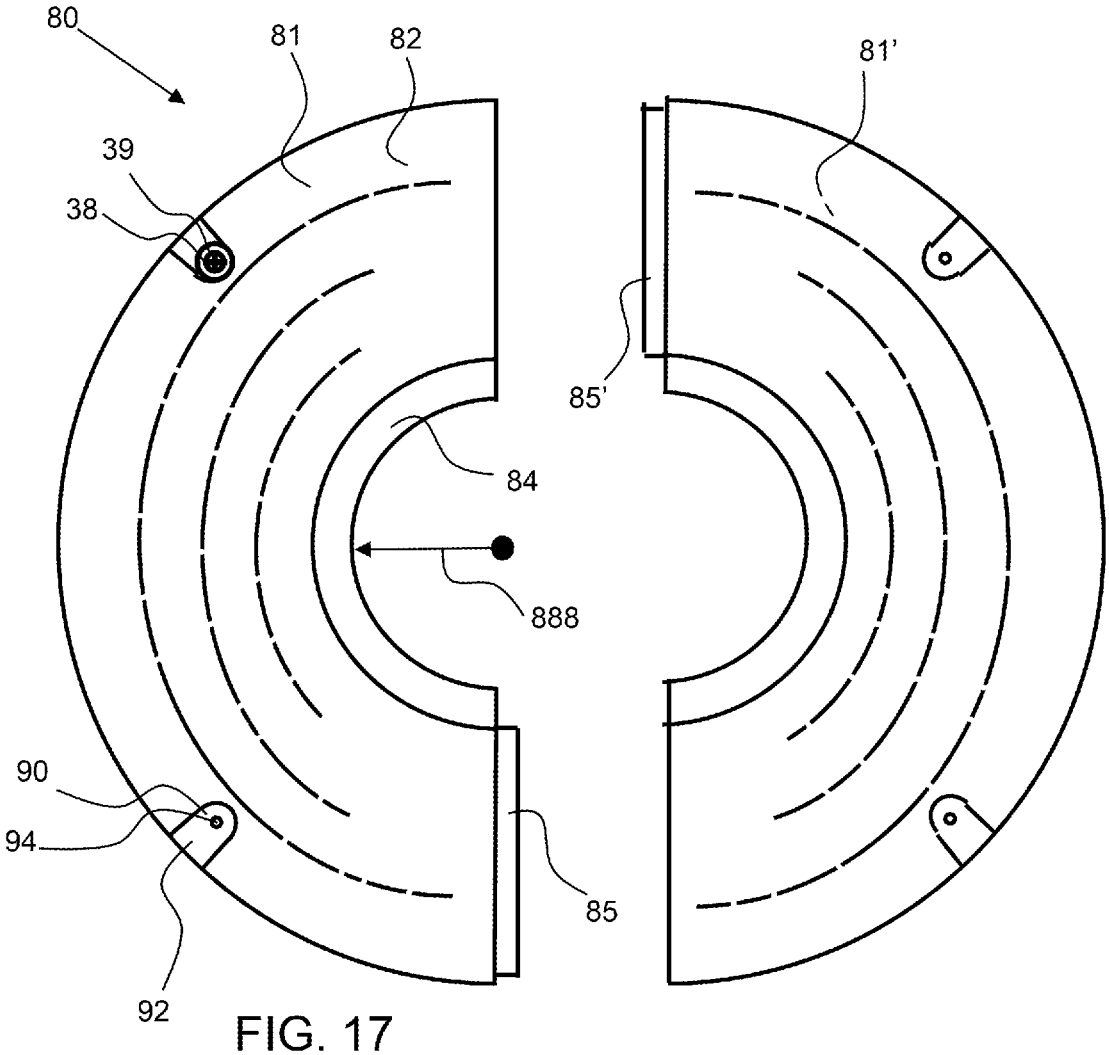
FIG. 17 shows a top view of the column cap of the lamp post column cap system.
Figure 18:
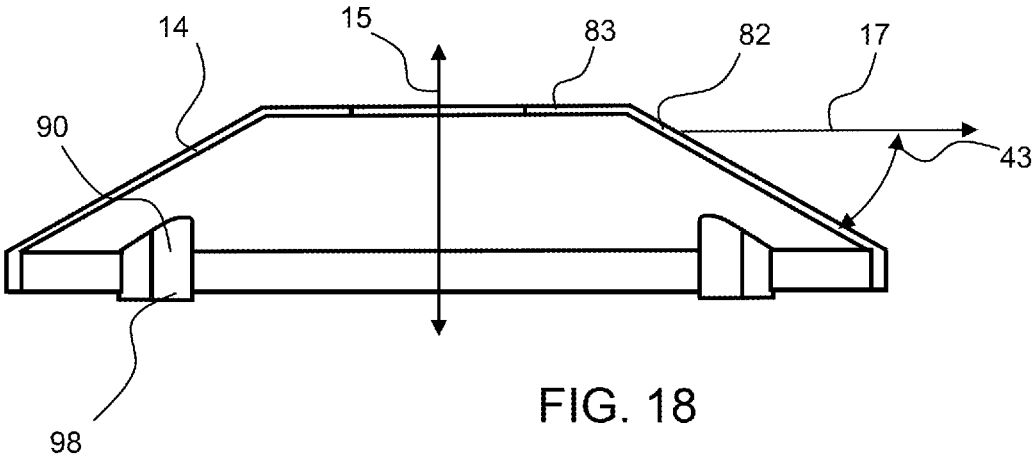
FIG. 18 shows a side cross-sectional view of the column cap of the lamp post column cap system.

Referring now to FIGS. 16 to 19, a column cap 80 of the lamp post column cap system may be configured as two column cap components 81, 81'. The two column cap components may be the same design, having the same shape and features. Each of the column cap components have a coupling flange 85, 85' configured to extend under opposing column cap component to couple together the two column cap components. Each column cap component extends a portion around the lamp post, such as about a half a circle or about 180 degrees along a radius. Each column cap component has cap feet 90 that extend down to form the drainage gap 86 shown in FIG. 11. A cap foot 90 may include a fastener aperture 94 for receiving a fastener 38, such as a screw 39, therethrough. Also, each cap foot 90 may be formed by a foot recess 92 from the cover extension 82, which enables the column cap component 81 to be molded from a single sheet of material, wherein the column cap component is a contiguous planar sheet of material, such as a plastic sheet 14. The cover extension 82 extends along an extension angle 43 from a horizontal axis 17. A vertical axis 15 is also shown in FIG. 18. A post flange 84 extends along a concave post extension 83 that extends along a radius of curvature 888 that is configured to conform to the lamp post diameter 34 of the post 30 shown in FIG. 1. The foot extension 98 is shown in FIG. 18 and extends a drainage gap height 87 as shown in FIG. 11. The cap foot 90' shown in FIG. 19 shows that the cap foot is a foot recess 92 from the cover extension 82. A column cap may have a drainage flange 89 that extends down from the cover extension 82 along an outer perimeter of the column cap 80.

Referring now to FIGS. 20 to 24, a lamp post column cap assembly 12 is a lamp post column cover system 11 that includes a column cap 80 configured over the column flange portion 677 of a column sleeve-flange 670 that includes a column sleeve portion 676 configured to extend down along the lamp post column and said column flange portion, that extends over the top of the lamp post column. The lamp post column cover system 11 may include four components, two column cap portions 81, 81', and two column sleeve-flanges 670, 670', wherein the column sleeve 660 or column sleeve portion 676 extends from the column flange extension 674. The two column sleeve-flanges may be coupled together around the lamp post column and then the two column cap portions may be coupled together and then secured over the column flange portion of the column sleeve-flanges. The column flange extension 674 and column sleeve are a single piece of material and extends continuously down along the side of the lamp post column from the top 68 of the column sleeve to the base 66 of the column sleeve 660. Put another way, the column flange extension 674 forms the column sleeve 660 and extends down to the base 68. The two column sleeve-flanges have a split or column sleeve-flange edge 673, 673 that is coupled to the edge of the other opposite column sleeve-flange.

Figure 21:
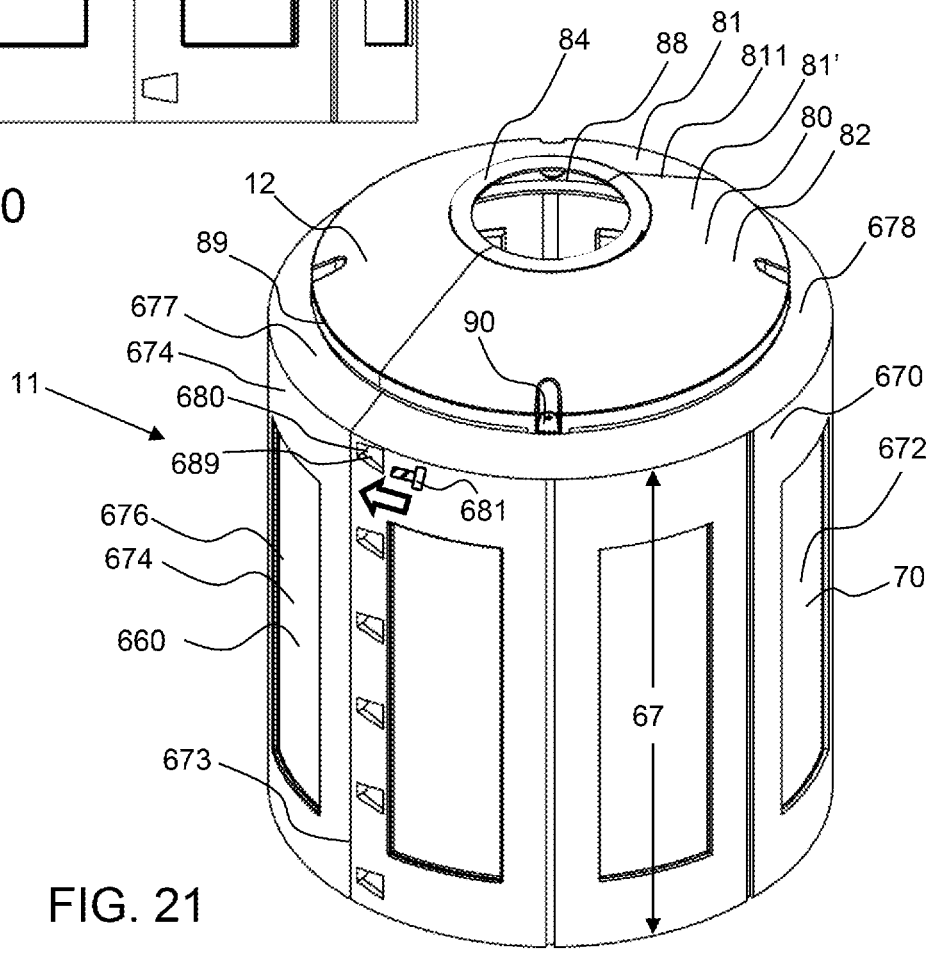
FIG. 21 shows a perspective view of the lamp post column assembly shown in FIG. 20, having two portions of the column cap coupled together to form the post opening and two portions the column sleeve-flange that each have a column flange portion that are configured to extend over the top of the lamp post column and under the column cap and the column sleeve portion configured to extend down along the lamp post column.
Figure 22:
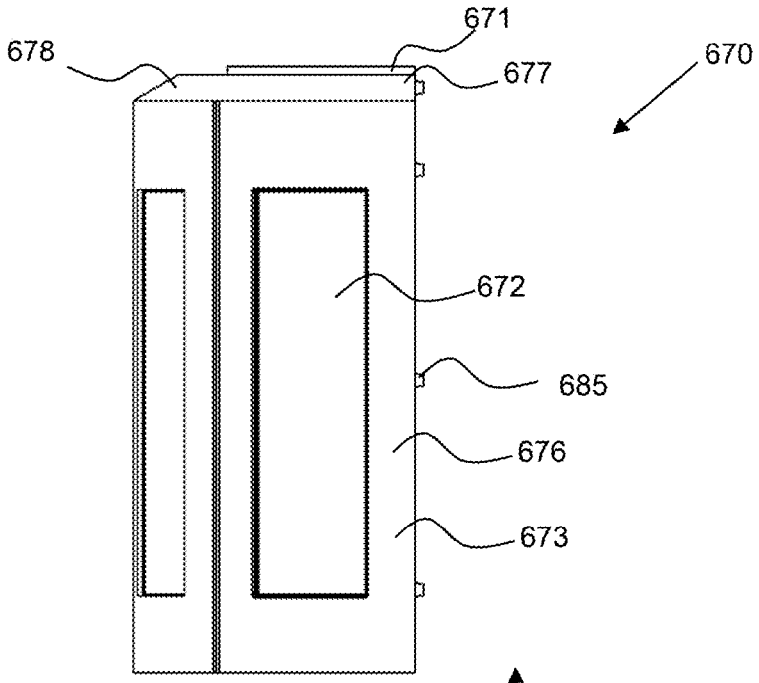
FIG. 22 shows a side view of a side of one of the column sleeve-flange portions having the column flange portion having a rain flange that extend vertically in use, and the column sleeve portion that has column sleeve attachments that include column sleeve-flange attachment protrusions configured along one column sleeve-flange edge (split) and a column sleeve-flange attachment recess along the other column sleeve-flange edge.
Figure 23:
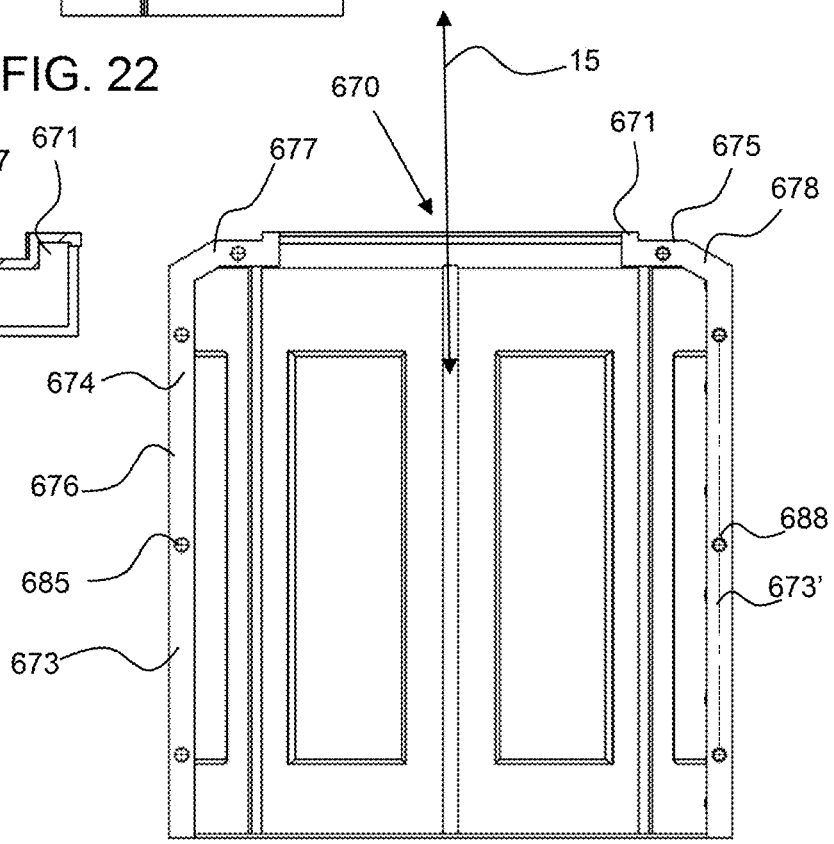
FIG. 23 shows a side view of the inside of one of the column sleeve-flange portions having the column flange portion having a rain flange that extend vertically in use, and the column sleeve portion that has column sleeve attachments that include column sleeve-flange attachment protrusions configured along one column sleeve-flange edge (split) and a column sleeve-flange attachment recess along the other column sleeve-flange edge.

The column sleeve-flange 670 extends continuously from the column flange portion 677 to the base 66 of the column sleeve portion 676 and may comprise two portions or components that are attached together along edges to encircle or extend around a lamp post column. As shown in FIG. 21, column-sleeve fasteners 681 may extend from a first column sleeve-flange portion to a second column sleeve-flange portion to form a column sleeve attachment 680. The column-sleeve fasteners 681 may extend into a column sleeve-flange attachment recess 689 as indicated by the bold arrow to prevent tampering with the fasteners and to produce a smooth outer profile of the column sleeve portion 676; to prevent protrusions that might snag on a person's clothing as they walk by the lamp post column cap assembly 12. Also, as shown in FIGS. 22 and 23, each column sleeve-flange 670 may include a plurality of column sleeve-flange edge protrusions 685 and corresponding column sleeve-flange edge recess 688 to receive the column sleeve-flange edge protrusion. The sleeve-flange edge protrusions 685 and the column sleeve-flange edge recess 688 may be configured on or extend from the column sleeve-flange edges 673, 673'. The two column sleeve-flange portions may be coupled together via insertion of the column sleeve-flange edge protrusions 685 into the column sleeve-flange edge recess 688 and subsequently, fastening the two portions together via the column sleeve fasteners 681.

Figure 20:
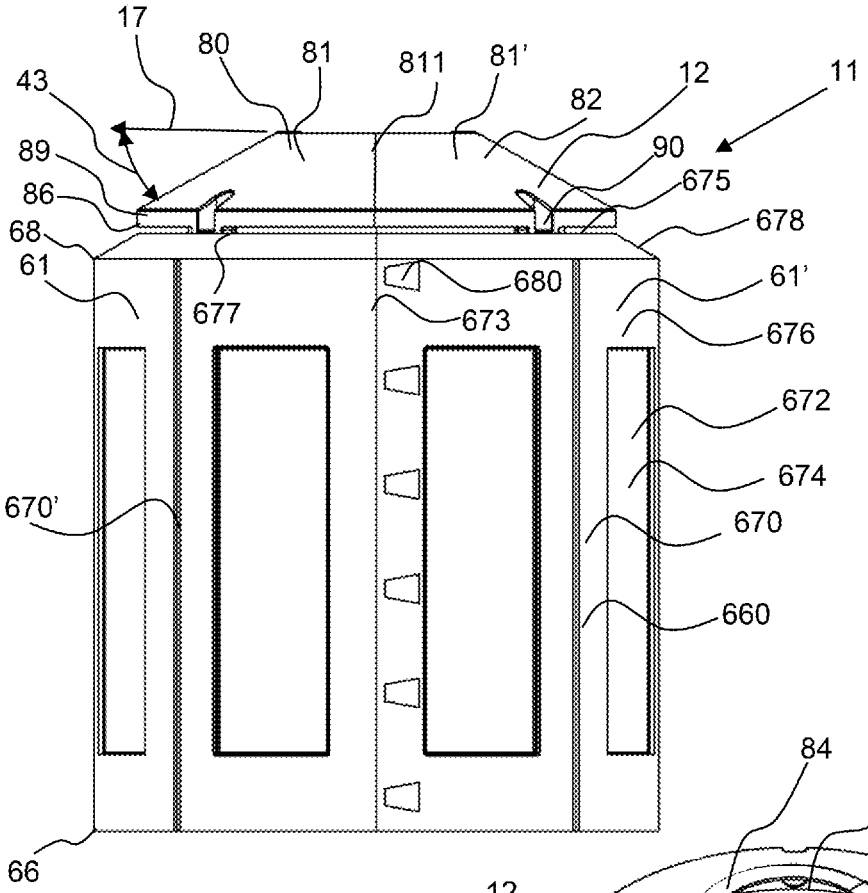
FIG. 20 shows a side view of a lamp post column cap assembly that includes a column cap configured over the column flange portion of column sleeve-flange that includes a column sleeve portion configured to extend down along the lamp post column.

The column cap 80 has a cover extension 82 that extends from the post flange 84 to the drainage flange 89 at an extension angle 43 from the horizontal axis 17 as shown in FIG. 20. The post flange 84 extends around the post opening as shown in FIG. 21. The cap feet 90 are best shown in FIGS. 17 to 19 and form a drainage gap 86 between the bottom edge of the drainage flange 89 and the column sleeve-flange 670, which may be about 2 mm or more to enable airflow and drainage. The column cap 80 may include a split or cap coupling edge 811 to enable the column cap to be configured around a lamp post. As shown in FIG. 21, the column cap 80 includes two column cap components 81, 81' and two splits or cap coupling edges 811.

Figure 24:
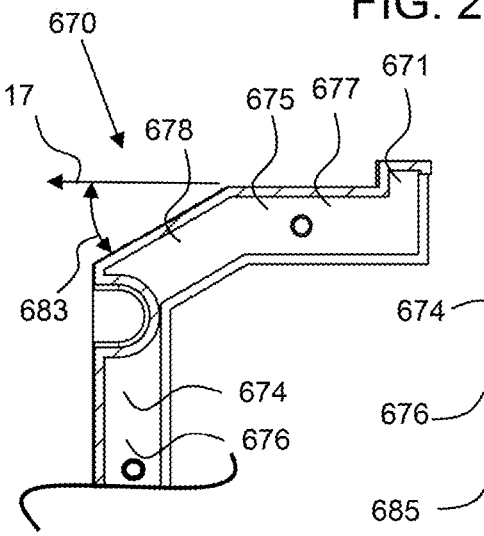
FIG. 24 shows a cross-sectional view of a portion of the column sleeve-flange shown in FIGS. 20 to 23 and having a column sleeve portion that is a column flange extension from the column flange portion that includes a cap flange drainage extension, a cap flange extension and a rain flange.

The column flange portion 677 of the column sleeve-flange 670 has a cap flange extension 675 that extends from the rain flange 671 over the top of the lamp post column, when in use, and may extend horizontally with respect to a vertical axis. The column flange portion 677 may also have a cap flange drainage extension 678 as shown in FIG. 24 extending at an extension angle 683 from horizontal, which may be about 25 degrees or more, about 30 degrees or more, about 45 degrees or more and any range between and including the angles provided. This sloped cap flange drainage extension may promote drainage of water from the cap flange extension 675 as well as from the cover extension 82 of the column cap 80. The rain flange 671 extends vertically up to stop water or rain from passing thereover and onto the lamp post or lamp post column.

The column sleeve portion 676 or column sleeve 660 may include column sleeve recessed areas 672, such as rectangular recesses areas, as shown. These recessed areas may improve the stiffness and rigidity of the column sleeve and may extend a substantial portion of the length or height of the column sleeve 660 from the base 66 to the top 68 and may have a length of about 50 mm or more, about 75 mm or more, about 100 mm or more, about 150 mm or more, about 200 mm or more and any range between and including the length values provided. The width of the column sleeve recessed areas 672 may be about 25 mm or more, about 50 mm or more about 75 mm or more, about 100 mm or more and any range between and including the values provided. The area of the recessed areas may me a substantial portion of the area of the column sleeve, such as about 25% or more, about 50% or more, or even about 70% or more and any percentage between and including the values provided.

The terms "up" and "down" are with respect to the vertical axis 15 and horizontal axis, wherein the lamp post has a length that extends vertically and the top of the lamp post column usually extends along the horizontal axis. A top of the lamp post column is with respect to the vertical axis.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A system comprising:

a) a lamp post column having a top;

b) a lamp post extending vertically from the lamp post column; and c) a column cap configured to extend around said lamp post and over said lamp post column, said column cap comprising:

i) a post opening configured to extend around the lamp post; and ii) a cover extension extending at an extension angle of at least 30 degrees for water to flow down over the cover extension;

iii) cap feet;

d) a column sleeve that extends around the lamp post column; and e) a column flange comprising:

i) a cap flange extension that extends over the top of the lamp post column;

ii) a column flange split extending across the column flange;

iii) a column flange extension that extends down along the lamp post column from the cap flange extension; and iii) a rain flange extending vertically up from the cap flange extension;

wherein in use, the cap feet are configured between the rain flange and the column flange extension of the column flange;

wherein the column sleeve extends from the column flange extension wherein the column sleeve and column flange are a column sleeve-flange, wherein the column sleeve and column flange are made of a single piece of material;

comprising a first column sleeve-flange and a second column sleeve-flange that are detachably attachable around the lamp post column;

wherein the cap feet produce a drainage gap between the rain flange and the column cap of at least 2 mm;

wherein each of the cap feet rest on the cap flange extension between the rain flange and the cap flange drainage extension;

wherein the column cap is configured a cap flange-offset distance from the column flange extension of the column flange of 30 mm or less.

2. The system of claim 1, wherein the column sleeve further comprises a column sleeve split extending from a base to a top of the column sleeve.

3. The system of claim 1, wherein the column sleeve comprises a first column sleeve portion and a second column sleeve portion and wherein in use, the first column sleeve portion and the second column sleeve portion are detachably attachable around the lamp post column.

4. The system of claim 1, wherein each of the first column sleeve-flange and the second column sleeve-flange comprise a plurality of column sleeve-flange edge protrusion along a first column sleeve-flange edges and a plurality of column sleeve-flange edge recesses along a second column sleeve-flange edge, wherein the column sleeve-flange edge protrusion are configured in the column sleeve-flange edge recesses to detachably attach the first column sleeve-flange to the second column sleeve-flange.

5. The system of claim 1, wherein the column cap comprises two separate column cap components.

6. The system of claim 1, wherein the column cap comprises two separate column cap components.

7. The system of claim 1, wherein the column sleeve comprises column sleeve recessed areas that extend a length of at least 50 mm and a width of at least 25 mm.

8. The system of claim 1, wherein each of the first column sleeve-flange and the second column sleeve-flange comprise column sleeve-flange edges and column sleeve attachments configured along the column sleeve-flange edges to attach the first column sleeve-flange to the second column sleeve-flange around the lamp post column.

9. The system of claim 8, further comprising column sleeve fasteners extending from the first column sleeve-flange into the second column sleeve-flange to attach the first column sleeve-flange to the second column sleeve-flange.

10. The system of claim 9, wherein each of the first and second column sleeve-flanges comprise column sleeve-flange attachment recesses for receiving one of said column sleeve fasteners therein to attach the first column sleeve-flange to the second column sleeve-flange around the lamp post column.

11. A system comprising;

a) a lamp post column having a top;

b) a lamp post extending vertically from the lamp post column; and c) a column cap configured to extend around said lamp post and over said lamp post column, said column cap comprising:

i) a post opening configured to extend around the lamp post; and ii) a cover extension extending at an extension angle of at least 30 degrees for water to flow down over the cover extension;

iii) cap feet;

d) a column sleeve that extends around the lamp post column; and e) a column flange comprising:

i) a cap flange extension that extends over the top of the lamp post column;

ii) a column flange split extending across the column flange;

iii) a column flange extension that extends down along the lamp post column from the cap flange extension; and iii) a rain flange extending vertically up from the cap flange extension;

wherein in use, the cap feet are configured between the rain flange and the column flange extension of column flange;

wherein the column sleeve extends from the column flange extension wherein the column sleeve and column flange are a column sleeve-flange, wherein the column sleeve and column flange are made of a single piece of material;

comprising a first column sleeve-flange and a second column sleeve-flange that are detachably attachable around the lamp post column;

wherein the column cap comprises two separate column cap components wherein each column cap components has a cap coupling edge that extends under the cover extension of an opposing column cap component.

12. A system comprising:

a) a lamp post column having a top;

b) a lamp post extending vertically from the lamp post column; and c) a column cap configured to extend around said lamp post and over said lamp post column, said column cap comprising:

i) a post opening configured to extend around the lamp post; and ii) a cover extension extending at an extension angle of at least 30 degrees for water to flow down over the cover extension;

iii) cap feet;

d) a column sleeve that extends around the lamp post column; and e) a column flange comprising:

i) a cap flange extension that extends over the top of the lamp post column;

ii) a column flange split extending across the column flange;

iii) a column flange extension that extends down along the lamp post column from the cap flange extension; and iii) a rain flange extending vertically up from the cap flange extension;

wherein in use, the cap feet are configured between the rain flange and the column flange extension of column flange;

wherein the column sleeve extends from the column flange extension wherein the column sleeve and column flange are a column sleeve-flange, wherein the column sleeve and column flange are made of a single piece of material;

comprising a first column sleeve-flange and a second column sleeve-flange that are detachably attachable around the lamp post column;

wherein the column cap comprises two separate column cap components; and wherein each of the cap feet rest on the cap flange extension between the rain flange and the cap flange drainage extension to form a drainage gap height between the cap flange extension of the column flange and the cover extension of the column cap of at least 2 mm.

* * * * *